US008070553B2

(12) United States Patent
Carnegie

(10) Patent No.: US 8,070,553 B2
(45) Date of Patent: Dec. 6, 2011

(54) DOLL WITH PHOTOGRAPHIC IMAGE

(76) Inventor: Peter A. Carnegie, Port Jefferson Station, NY (US)

( * ) Notice: Subject to any disclaimer, the term of this patent is extended or adjusted under 35 U.S.C. 154(b) by 150 days.

(21) Appl. No.: 12/559,262

(22) Filed: Sep. 14, 2009

(65) Prior Publication Data

US 2010/0075569 A1 Mar. 25, 2010

Related U.S. Application Data

(60) Provisional application No. 61/098,361, filed on Sep. 19, 2008.

(51) Int. Cl.
*A63H 3/02* (2006.01)
*A63H 3/00* (2006.01)

(52) U.S. Cl. ..... 446/369; 446/385

(58) Field of Classification Search ..... 446/147, 446/149, 268, 369, 385, 391, 372, 387, 390, 446/491
See application file for complete search history.

(56) References Cited

U.S. PATENT DOCUMENTS 833,448 A * 10/1906 De Vail et al. ..... 430/496
4,892,501 A * 1/1990 Girelli ..... 446/372
4,929,213 A * 5/1990 Morgan ..... 446/97
4,993,987 A * 2/1991 Hull et al. ..... 446/268
5,009,626 A * 4/1991 Katz ..... 446/391
5,383,187 A * 1/1995 Vardakas et al. ..... 370/312
5,515,592 A * 5/1996 Mills ..... 29/412
5,746,639 A * 5/1998 Bloom et al. ..... 446/98
5,779,516 A * 7/1998 Thorne ..... 446/98
5,947,791 A * 9/1999 Taylor ..... 446/321
6,244,926 B1 * 6/2001 George et al. ..... 446/391
6,782,128 B1 * 8/2004 Rinehart ..... 382/167
2003/0236050 A1 * 12/2003 Landry ..... 446/369

* cited by examiner

*Primary Examiner* — Kien Nguyen

(74) *Attorney, Agent, or Firm* — Italia IP; James A. Italia

(57) ABSTRACT

A doll arranged to depict a person realistically. A first image of a person such as a photograph is ultimately transferred to a flexible substrate such as a fabric sheet. The substrate is cut or trimmed generally to configuration of a human body. The substrate is joined to a corresponding rear substrate, thereby forming an outer shell having an open interior. The interior may be stuffed with soft material. The outer shell is then sealed to preclude escape of stuffing material. Optionally, the rear substrate may bear a second image such as that of the rear of the person furnishing the first image. The doll may range in size from very small to full body dimensions or may be even larger.

18 Claims, 3 Drawing Sheets

DOLL WITH PHOTOGRAPHIC IMAGE

CROSS-REFERENCE TO RELATED APPLICATION

This application claims the benefit of the filing date under 35 USC 119(e) of the filing date of U.S. Provisional Application Ser. No. 61/098,361, filed Sep. 19, 2008, the contents of which are incorporated herein by reference.

FIELD OF THE INVENTION

The present invention relates to dolls, and more particularly, to dolls which simulate a real person by incorporating a reproduced image thereon.

BACKGROUND OF THE INVENTION

Dolls which intentionally simulate real people and fictitious characters are known. These dolls typically rely on reproducing characteristics of the intended subject person or character on the doll. Illustratively, hair and other facial colors and contours may be imprinted on a doll. The doll may be configured in three dimensions to reproduce as best possible the three dimensional characteristics of the human subject.

Dolls may be made to any scale, including full or near full size, and even greater, as well as to scale reduced from life size. Dolls may be formed in many ways, including molding from plastic and sewing fabric panels into the final form, among others.

However, dolls are generally intended for the mass market, and do not have personalized characteristics for most people.

SUMMARY OF THE INVENTION

The present invention provides a doll which simulates any selected person, both in visual characteristics and, optionally, in size or scale. Reproduction of the visual characteristics is highly authentic as photography of the intended human subject is employed.

The method of making a doll according to at least one aspect of the present invention may utilize a body photograph or other image of a selected human subject. The image may be imposed onto a transfer medium and is ultimately imposed onto a fabric. The fabric is suitably trimmed and joined to a rear panel which corresponds to the rear of the human subject as to body position and scale. The two fabrics are joined to form a hollow flaccid outer shell, which may then be stuffed with soft materials. The doll may be completed by joining all free edges together.

It will be appreciated that because it is practical to obtain suitable images of people such as family members for example, it is also practical to form personalized dolls, and not just dolls having famous human subjects. It is also feasible to produce dolls of any desired scale. Whereas dolls fabricated by a molding process are limited to mold sizes, dolls fabricated according to the invention may be made to any desired scale quite easily.

Optionally, the rear of the doll may be provided with an image corresponding to the human subject. This rear image may be of the rear of the human subject.

It is an object of the invention to provide a doll having a realistic or recognizable visual appearance.

Another object of the invention is to provide a doll having a personalized visual appearance.

A further object is to provide a practical way of making dolls of full or near full size and scale.

It is an object of the invention to provide improved elements and arrangements thereof by apparatus for the purposes described which is inexpensive, dependable, and fully effective in accomplishing its intended purposes.

These and other objects of the present invention will become readily apparent upon further review of the following specification and drawings.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 1:
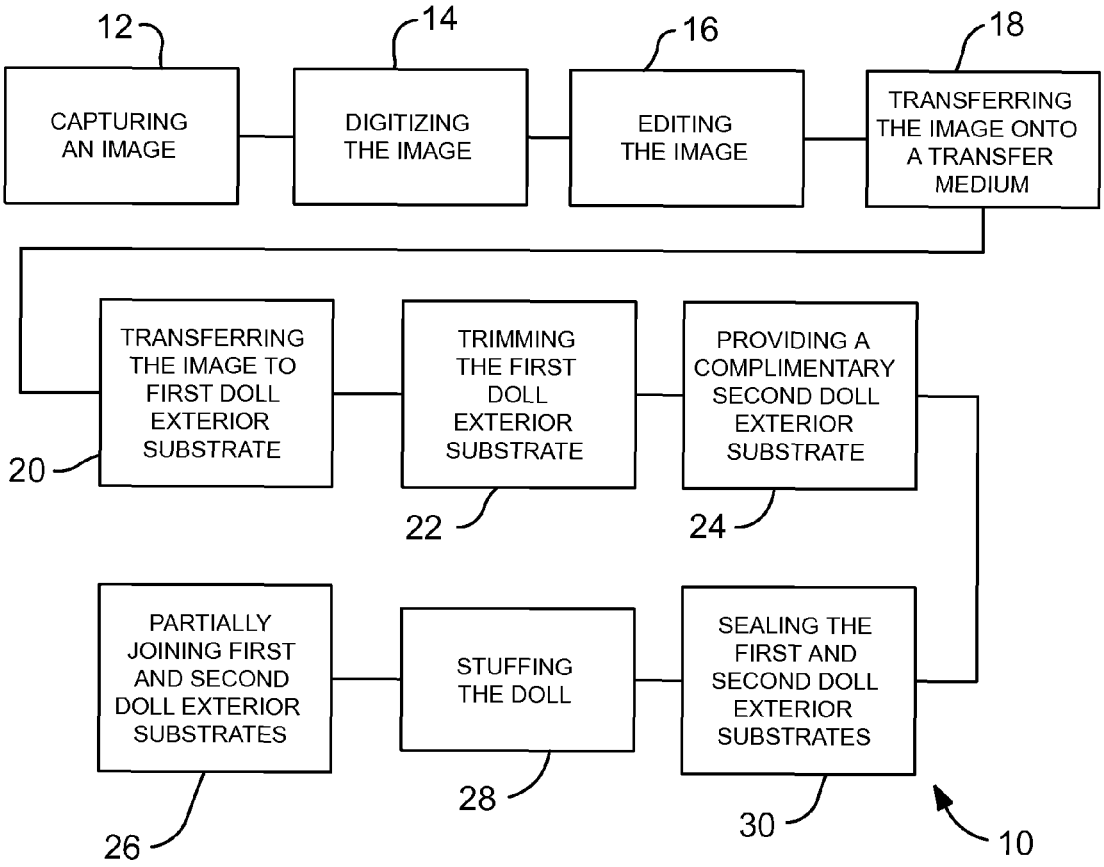
FIG. 1 is a block diagram of summarized steps of making a doll according to at least one aspect of the invention.

Referring first to FIG. 1, according to at least one aspect of the invention, a doll 100 may be made using the following method 10. The method 10 may result in a doll simulating the appearance of a person. In a first step 12, an image of the intended subject, such as a full body image extending from the head to the feet of a person standing upright, is captured or taken. Of course, any body posture or position may be used depending on the intended layout of the finalized doll. This may be done with a digital camera or with a chemical film camera. As employed herein, the term "camera" will encompass any type of source capable of generating an image, including for example computerized drawing systems and hand rendered artwork such as pen and pencil drawings, oil and water color paintings, stippling, and others.

In a second step 14, which is only necessary if the camera itself is not of the digital type, the image is digitized. For example, a photograph or print from a chemical film camera may be scanned in a scanner. If the camera is digital, then the step 14 of digitizing the image is automatically performed.

In a fourth step 16, which is practiced only if the image is not suitable in its originally captured form, the image is edited. Editing encompasses any and all alterations from the image as captured, such as adding or deleting visual elements, changing colors and proportions, changing the dimensions of the image, and any other known modifications to images. The image may be enlarged to life scale for example. The step 16 of editing, where enlargement of an image is desired, may be performed integrally with a subsequent step 18 of transferring the image onto a transfer medium (not shown). For example, heat transfer paper (not shown) provides a known and commercially available transfer medium. The image may be transferred for example printing from the photograph or other image onto the transfer medium.

In a step 20, and referring also to FIG. 1, the image may be imposed onto a first doll exterior substrate 102 (seen in final form in FIG. 3, as will be discussed hereinafter) by printing the image onto the sheet 104 using the transfer medium. After printing, the image is depicted in solid lines as the silhouette 108 of a human form.

Figure 2:
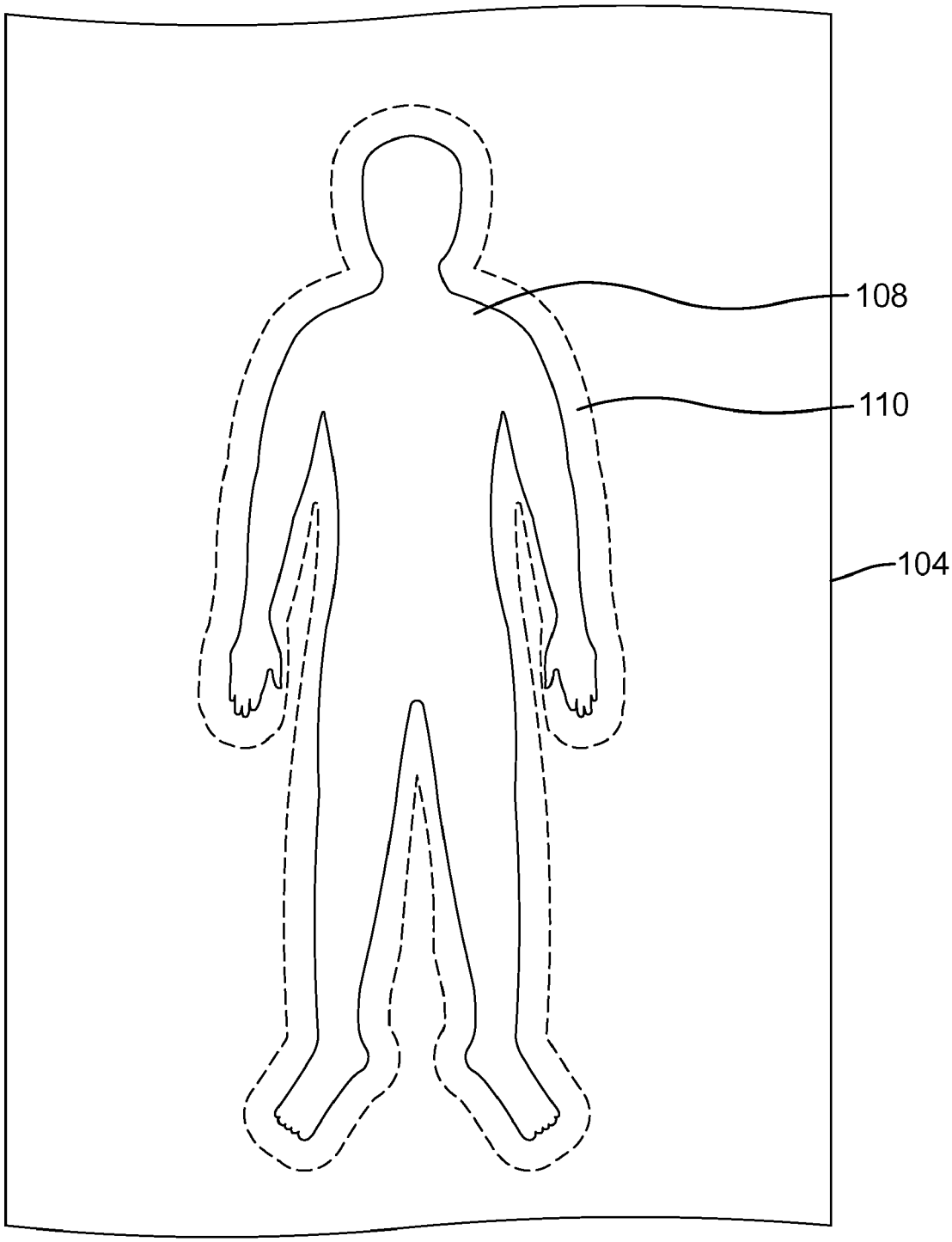
FIG. 2 is a plan view of one panel of a doll according at least one aspect of the invention, shown prior to completion.

Turning momentarily to FIG. 2, the first doll exterior substrate 102 (see FIG. 3) may be formed from a sheet 104 of a fabric or other flexible substrate suitable for forming the outer skin or shell of a doll such as the doll 100.

To form a doll such as the doll 100, which generally has an outer shape configured to simulate a human body, the sheet 104 may be trimmed to form a suitable partial pattern. To do this, and as seen as a step 22 in FIG. 1, the sheet 104 may be cut such that there is a zone 110 of generally even width outside the silhouette 108. In FIG. 2, the zone 110 is depicted as being bounded by a broken line at its exterior or periphery.

To form a generally three dimensional doll, such as the doll 100, the first doll exterior substrate 102 is provided with a complementary second doll exterior substrate 112. Forming the second doll exterior substrate 112 is shown in FIG. 1 as a step 24.

Actual fabrication of the second doll exterior substrate 112 may be performed by the same steps used to fabricate the first doll exterior substrate 102, and need not be repeated herein. According to one aspect of the invention, the second doll exterior substrate 112 may depict the rear of the human subject shown from the front on the first doll exterior substrate 102. To accomplish this, a second image of the rear of the human subject is captured and taken. The second image may be used to form the second doll exterior substrate 112.

Figure 3:
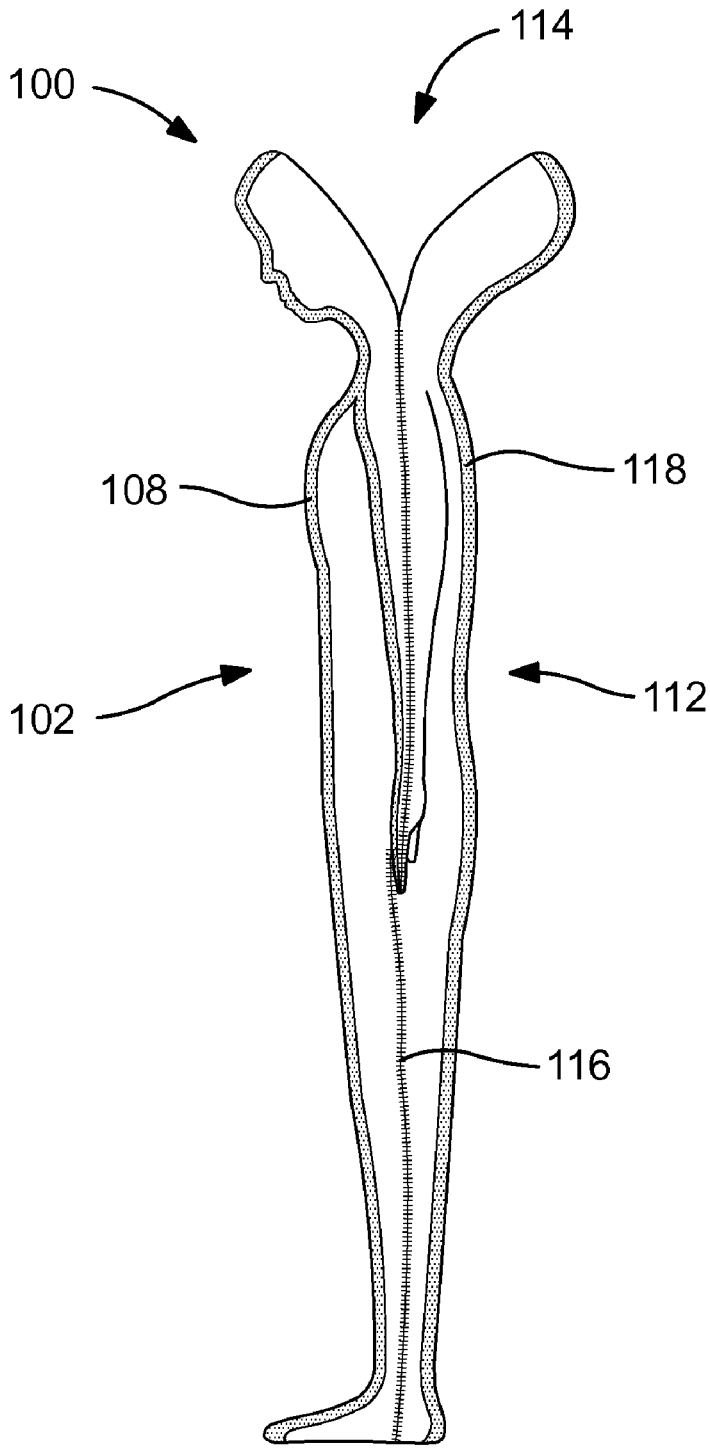
FIG. 3 is a side view of a doll according at least one aspect of the invention, shown prior to completion.

In a step 26, the first doll exterior substrate 102 is joined to the second doll exterior substrate 112 at the respective peripheral edges, leaving an unjoined portion 114 of the peripheral edges open. This is shown in FIG. 3. When using fabric sheets such as the fabric sheet 104, the first doll exterior substrate 102 may be stitched to the second doll exterior substrate 112 at the peripheral edges thereof. This is shown as a stitched seam 116 in FIG. 3. At this point, a mostly closed interior is generated between the first doll exterior substrate 102 and the second doll exterior substrate 112.

In a step 28, the doll 100 may be stuffed with any suitable stuffing material (not shown), such as cotton batting. The stuffing material may be inserted into the mostly closed interior using the opening formed at the unjoined portion 114 for access.

In a step 30, the unjoined portion closed is sealed. This may be performed for example by stitching to continue and extend the seam 116.

FIG. 3 also shows a rear image 118 formed on the second doll exterior substrate 112. Thus it may be said that the doll 100 may display the front of the human subject when viewed from the front, which in the depiction of FIG. 3 is the left side of the doll 100, and may display the rear of the human subject when viewed from the rear or the right side of the doll 100, as shown in FIG. 3.

It should be noted at this point that orientational terms such as left and right refer to the subject drawing as viewed by an observer. The drawing figures depict their subject matter in orientations of normal use, which could obviously change with changes in body posture and position. Therefore, orientational terms must be understood to provide semantic basis for purposes of description, and do not limit the invention or its component parts in any particular way.

According to a further aspect, the invention may comprise a doll such as the doll 100, made according to at least some of the above steps.

Although the invention has been described in terms of certain components being referred to in either the singular or the plural, other arrangements are possible. For example, it is to be understood that due to the conceptual description presented herein, components presented in the singular may be provided in the plural. Illustratively, the first doll exterior substrate 102 and the second doll exterior substrate 112, although shown as being formed from a single piece of material, may be made up from plural complementing pieces (this is not shown). Where feasible, it would be possible to provide a single component rather than a plurality of components. For example, the first doll exterior substrate 102 and the second doll exterior substrate 112 may be formed from a single unitary sheet of material.

The rear image may be that of the rear of the human subject. Alternatively, it may be the front of the human subject, the front of another human subject, or still another image. It may for example comprise an image of a person known to be associated with the human subject providing the front image, such as a well known pair of entertainment performers, a president and a vice president of the United States, or of more private people such as a husband and wife.

The front and rear images need not correspond only to the front and rear images of the human subject. Illustratively, the front and rear images may be identical. Alternatively, the front and rear images may depict different aspects of the same person. The front and rear images may both show the front or both show the rear of the same person. For example, the front image may be that showing a smiling and happy demeanor, while the rear image may be one showing a frowning and unhappy demeanor. The front image may display a formal condition of dress or general appearance, while the rear image may display an informal condition of dress or general appearance. In another example, the front image may display an appearance which is associated with one profession or activity, while the rear image may display an appearance which is associated with another profession or activity. In a further example, a humorous effect may be obtained in which the front image conveys a clean and orderly impression, while the rear image may convey a dirty and disorderly impression, such as the result of having been in a fight or having gotten excessively drunk, or otherwise disarranged.

It would be possible to render the front and if desired rear images in digital form and to manipulate the digital images to accommodate transition from a two dimensional format to the finalized three dimensional format of the doll. Illustratively, some dimensions may be exaggerated to provide more realistic effects when viewing the doll in its final stuffed, three dimensional form, compared to the visual effects of merely imposing a two dimensional image onto a three dimensional surface. Image manipulation may also be employed to introduce editing changes intended to improve, emphasize aspects of, or otherwise alter the visual appearance of the human subject.

It would be possible to form a doll according to another aspect of the invention by selectively stitching the front and rear panels together, thereby avoiding the step of trimming while still achieving a three dimensional effect.

The sheet 104 bearing the image which is only representatively shown as the silhouette 108 in FIG. 2 may be utilized for purposes other than to form the doll 100 shown in FIG. 3. For example, the sheet 104 may be used as one panel to form a pillow.

The order of the steps 12 . . . 30 may be reordered to suit, and some of the steps 12 . . . 30 may be omitted or substituted if desired. For example, stuffing material may be put in place prior to forming the seam 116 prior to the step 26 of joining the first doll exterior substrate 102 to the second doll exterior substrate 112 at the respective peripheral edges, leaving an unjoined portion 114 of the peripheral edges open. This variation could be employed where a generally form holding unitary stuffing material is used, such as for example a precut section of polymeric foam (not shown). In such case, the foam could be placed on one of the first doll exterior substrate 102 and the second doll exterior substrate 112, and held by adhesive, gravity, a jig, or by other ways prior to any stitching or joining of the first doll exterior substrate 102 and the second doll exterior substrate 112.

Constituency of the first doll exterior substrate 102 and the second doll exterior substrate 112 may be other than fabric, such as plastic sheet. The first doll exterior substrate 102 and the second doll exterior substrate 112 may be different in their constituency.

The present invention is susceptible to modifications and variations which may be introduced thereto without departing from the inventive concepts. For example, although the invention has been described with respect to people, and to erect, standing postures, it would be possible to simulate animals and to change the posture from erect, standing postures.

While the present invention has been described in connection with what is considered the most practical and preferred embodiment, it is to be understood that the present invention is not to be limited to the disclosed arrangements, but is intended to cover various arrangements which are included within the spirit and scope of the broadest possible interpretation of the appended claims so as to encompass all modifications and equivalent arrangements which are possible.

I claim:

1. A method of making a doll of predetermined scale simulating the appearance of a person, comprising the steps of:

obtaining a first full body image of the front of a person extending from the head to the feet of the person;

rendering the first full body image to a predetermined scale;

imposing the first full body image onto a transfer medium;

obtaining a second full body image of the rear of a person extending from the head to the feet of the person;

rendering the second full body image to a predetermined scale;

imposing the second full body image onto a transfer medium;

selecting from the first or second full body image;

transferring the selected full body image onto a first doll exterior substrate;

forming a second doll exterior substrate;

joining the first doll exterior substrate at the peripheral edges to the second doll exterior substrate, while leaving an unjoined portion of the peripheral edges open, thereby generating a mostly closed interior;

stuffing the joined first doll exterior substrate and second doll exterior substrate, using the unjoined portion for access to the mostly closed interior; and sealing the unjoined portion closed.

2. The method of claim 1, wherein the step of transferring the image onto a first doll exterior substrate comprises the further step of trimming the doll exterior substrate such that a generally uniform border is formed around the transferred image.

3. The method of claim 1, wherein the step of obtaining an image of a person comprises obtaining a front view photographic image, and the step of transferring an image onto the second doll exterior substrate comprises transferring a rear view photographic image onto the second doll exterior substrate.

4. A doll made by the method of claim 3.

5. The method of claim 1, comprising the further step of digitizing the image.

6. The method of claim 1, wherein the step of imposing the image onto a first doll exterior substrate comprises the further step of printing a photograph onto a transfer medium.

7. The method of claim 6, wherein the transfer medium is transfer paper.

8. A doll bearing a human image, comprising:

a front side flexible exterior substrate having a periphery;

a rear side flexible exterior substrate having a periphery which is joined to the periphery of the front side flexible exterior substrate to define a mostly closed interior disposed within and surrounded by the front side flexible exterior substrate and the rear side flexible exterior substrate; and an image selected from the group consisting of the front of a person and the rear of said person wherein the selected image is disposed on the front side flexible exterior substrate, wherein the doll has a generally three dimensional outer shape generally configured to simulate a human body.

9. The doll according to claim 8, wherein the image selected for the front side flexible exterior substrate is the front of said person and the image for the rear side flexible exterior substrate is the rear of said person.

10. The doll according to claim 8, further comprising stuffing disposed within the mostly closed interior.

11. The doll according to claim 8, wherein the doll is fabricated generally to life scale.

12. A method of making a doll of predetermined scale simulating the appearance of a person, comprising the steps of:

obtaining a first full body image of the front of a person extending from the head to the feet of the person;

rendering the first full body image to about life scale;

imposing the first full body image onto a transfer medium;

transferring the first full body image onto a first doll exterior substrate;

forming a second doll exterior substrate;

transferring a second image of the rear of the person onto the second doll exterior substrate;

joining the first doll exterior substrate at the peripheral edges to the second doll exterior substrate, while leaving an unjoined portion of the peripheral edges open, thereby generating mostly closed interior;

stuffing the joined first doll exterior substrate and second doll exterior substrate, using the unjoined portion for access to the mostly closed interior; and sealing the unjoined portion closed.

13. The method of claim 12, wherein the step of transferring the image onto a first doll exterior substrate comprises the further step of trimming the doll exterior substrate such that a generally uniform border is formed around the transferred image.

14. The method of claim 12, wherein the step of obtaining an image of a person comprises obtaining a front view photographic image, and the step of transferring an image onto the second doll exterior substrate comprises transferring a rear view photographic image onto the second doll exterior substrate.

15. A doll made by the method of claim 14.

16. The method of claim 12, comprising the further step of digitizing the image.

17. The method of claim 12, wherein the step of imposing the image onto a first doll exterior substrate comprises the further step of printing a photograph onto a transfer medium.

18. The method of claim 17, wherein the transfer medium is transfer paper.

* * * * *